US006385775B1

(12) United States Patent
Komjati

(10) Patent No.: US 6,385,775 B1
(45) Date of Patent: May 14, 2002

(54) APPAREL, SUCH AS A JACKET OR RAIN GEAR, WHICH IS COLLAPSIBLE INTO ITS SLEEVE TO FORM A FANNY PACK, SHOULDER PACK, HAND PACK OR BACK PACK CONFIGURATION

(76) Inventor: Diana L. Komjati, 422 Northvale Dr., Chippewa Lake, OH (US) 44215

( * ) Notice: Subject to any disclaimer, the term of this patent is extended or adjusted under 35 U.S.C. 154(b) by 0 days.

(21) Appl. No.: 09/382,159

(22) Filed: Aug. 24, 1999

(51) Int. Cl.[7] ..... A41D 3/02
(52) U.S. Cl. ..... 2/86
(58) Field of Search ..... 2/86, 108, 84, 2/85, 87, 94, 88, 102; 383/4; 224/577

(56) References Cited

U.S. PATENT DOCUMENTS 4,055,853 A * 11/1977 Argento et al. ..... 2/93
4,307,470 A * 12/1981 Ezell ..... 2/108
4,347,629 A * 9/1982 Itoi ..... 2/108
4,389,735 A * 6/1983 McLaughlin ..... 2/94
4,476,587 A * 10/1984 Itoi ..... 2/94
4,502,155 A * 3/1985 Itoi ..... 2/115
4,563,777 A * 1/1986 Park ..... 2/108
4,862,520 A * 9/1989 Gazzola ..... 2/85
5,123,117 A * 6/1992 Prendergast ..... 2/108
5,165,111 A * 11/1992 Lieberman ..... 2/94
5,743,448 A * 4/1998 Tsai ..... 224/153
5,996,121 A * 12/1999 Harris ..... 2/69

* cited by examiner

*Primary Examiner*—Amy Vanatta
*Assistant Examiner*—Alissa L. Hoey
(74) *Attorney, Agent, or Firm*—Scott M. Oldham; Hahn Loeser + Parks, LLP

(57) ABSTRACT

Apparel, such as a jacket or rain gear, which is collapsible into its sleeve to form a fanny pack, shoulder pack, hand pack or back pack configuration which includes a releasable fastener which retains two (2) outwardly extending ends of an adjustable belt member attached to the apparel, such as a jacket or rain gear. The length of the adjustable belt member is readily adjustable by the user to permit the apparel, such as a jacket or rain gear, to be carried as a fanny pack, shoulder pack, hand pack or back pack, as desired by the user, when the apparel, such as a jacket or rain gear, is not in use. When it is desired to use the apparel, such as a jacket or rain gear, it is quickly and readily converted from its fanny pack, shoulder pack, hand pack or back pack configuration into apparel, such as a jacket or rain gear, ready for use.

19 Claims, 3 Drawing Sheets

APPAREL, SUCH AS A JACKET OR RAIN GEAR, WHICH IS COLLAPSIBLE INTO ITS SLEEVE TO FORM A FANNY PACK, SHOULDER PACK, HAND PACK OR BACK PACK CONFIGURATION

BACKGROUND AND SUMMARY OF THE INVENTION

The present invention relates generally to new and novel apparel, such as a jacket or rain gear, which is collapsible into its sleeve to form a fanny pack, shoulder pack, hand pack or back pack configuration. More particularly, the present invention relates to apparel, such as a jacket or rain gear, which is collapsible into its sleeve to form a fanny pack, shoulder pack, hand pack or back pack configuration which is cost effective, lightweight, compact and easy to use.

In many situations, such as taking a walk or attending outdoor spectator activities, such as outdoor sporting events or outdoor concerts, one must decide whether or not to take along apparel, such as a jacket or rain gear. If apparel, such as a jacket or rain gear, is taken, but not used, it must be carried and/or placed under one's seat. This is not only bothersome, but the apparel, such as a jacket or rain gear, could become damaged, such as having lit cigarettes, drinks and/or food spilled thereon, left behind or stolen. On the other hand, if a decision is made not to take the apparel, such as a jacket or rain gear, along, this decision may be later regretted as the temperature drops during evening hours and/or if precipitation, such as rain, develops.

Accordingly, an object of the present invention is the provision of apparel, such as a jacket or rain gear, which is collapsible into its sleeve to form a fanny pack, shoulder pack, hand pack or back pack configuration which is cost effective, light weight, compact and easy to use.

Another object of the present invention is to provide apparel, such as a jacket or rain gear, which is collapsible into its sleeve to form a fanny pack, shoulder pack, hand pack or back pack configuration which does not require an additional "stuff" pocket or "stuff" pack.

Yet another object of the present invention is to provide apparel, such as a jacket or rain gear, which is collapsible into its sleeve to form a fanny pack, shoulder pack, hand pack or back pack configuration which does not alter the basic apparel design.

Still another object of the present invention is to provide apparel, such as a jacket or rain gear, which is collapsible into its sleeve to form a fanny pack, shoulder pack, hand pack or back pack configuration which can be incorporated into various standard apparel designs, including full zipper, partial zipper and pull over apparel designs, with the only additional element being an adjustable belt member.

This and other objects of the present invention are attained by the provision of apparel, such as a jacket or rain gear, which is collapsible into its sleeve to form a fanny pack, shoulder pack, hand pack or back pack configuration which includes a releasable fastener which retains two (2) outwardly extending ends of an adjustable belt member attached to the apparel, such as a jacket or rain gear. The length of the adjustable belt member is readily adjustable by the user to permit the apparel, such as a jacket or rain gear, to be carried as a fanny pack, shoulder pack, hand pack or back pack, as desired by the user, when the apparel, such as a jacket or rain gear, is not in use. When it is desired to use the apparel, such as a jacket or rain gear, it is quickly and readily converted from its fanny pack, shoulder pack, hand pack or back pack configuration into apparel, such as a jacket or rain gear, ready for use.

Other advantages and novel features of the present invention will become apparent in the following detailed description of the invention when considered in conjunction with the accompanying drawings.

DETAILED DESCRIPTION OF THE DRAWINGS

Figure 1:
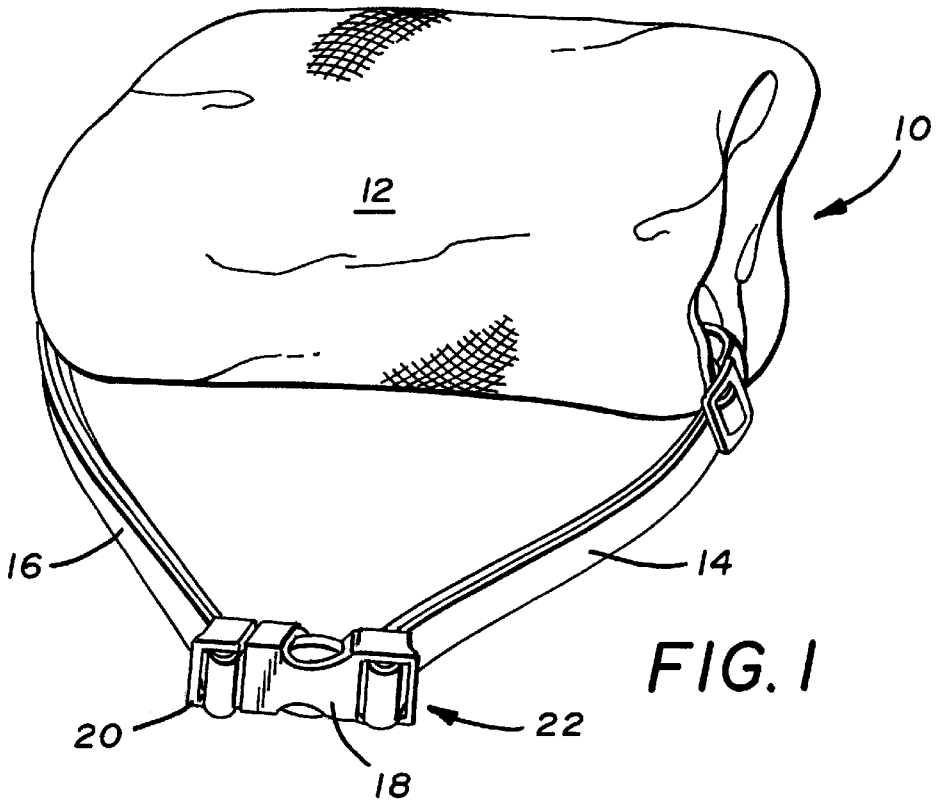
FIG. 1 is a front perspective view of apparel, such as a jacket or rain gear, which is collapsible into its sleeve to form a fanny pack, shoulder pack, hand pack or back pack configuration collapsed into its sleeve to form a fanny pack, shoulder pack, hand pack or back pack configuration in accordance with a preferred embodiment of the present invention.

In the following detailed description of a preferred embodiment of the present invention, reference is made to the accompanying drawings which, in conjunction with this detailed description, illustrate and describe a preferred embodiment of apparel, such as a jacket or rain gear, which is collapsible into its sleeve to form a fanny pack, shoulder pack, hand pack or back pack configuration, generally identified by reference number 10, in accordance with the present invention. Referring to the Figures, in which like-referenced characters represent corresponding features throughout the several views, attention is first directed to FIG. 1, which shows a front perspective view of apparel, such as a jacket or rain gear, which is collapsible into its sleeve to form a fanny pack, shoulder pack, hand pack or back pack configuration 10 collapsed into its sleeve to form a fanny pack, shoulder pack, hand pack or back pack configuration, in accordance with a preferred embodiment of the present invention, apparel, such as a jacket or rain gear, which is collapsible into its sleeve to form a fanny pack, shoulder pack, hand pack or bark pack configuration 10 generally includes apparel 12, such as a jacket or rain gear, adjustable belt member having first outwardly extending end 14 and second outwardly extending end 16 first end 18 and second end 20 of releasable fastener 22 which are attached to outwardly extending ends of first outwardly extending end 14 and second outwardly extending end 16 of adjustable belt member, respectively.

Referring now to FIGS. 2 through 6, which show apparel, such as a jacket or rain gear, which is collapsible into its sleeve to form a fanny pack, shoulder pack, hand pack or back pack configuration 10 showing apparel 12, such as a jacket or rain gear, being collapsed into its sleeve to form a fanny pack, shoulder pack, hand pack or back pack configuration in accordance with a preferred embodiment of the present invention. In particular, one of first outwardly extending end 14 and second outwardly extending end 16 of the adjustable belt member is pulled through a sleeve of apparel 12 and first end 18 of releasable fastener 22 is engaged with second end 20 of releasable fastener 22. The remainder of apparel 12 is then stuffed into the selected sleeve of apparel 12 and the adjustable belt member is adjusted, as desired, to form apparel, such as a jacket or rain gear, which is collapsible into its sleeve to form a fanny pack, shoulder pack, hand pack or back pack configuration 10 into its fanny pack, hand pack or back pack configuration.

Figure 2:
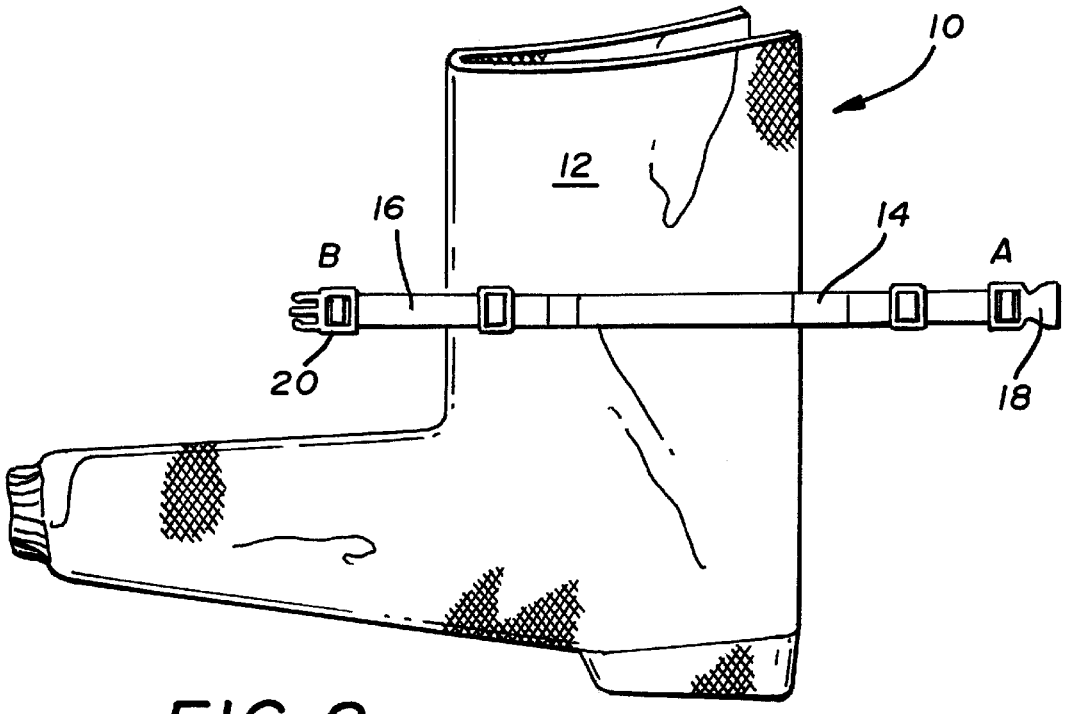
FIG. 2 is a top elevational view of apparel, such as a jacket or rain gear, which is collapsible into its sleeve to form a fanny pack, shoulder pack, hand pack or back pack configuration showing the first step of being collasped in accordance with the embodiment of the present invention shown in FIG. 1.

Referring now to FIG. 2, which shows a top elevational view of apparel, such as a jacket or rain gear, which is collapsible into its sleeve to form a fanny pack, shoulder pack, hand pack or back pack configuration 10 showing the first step of a method of apparel 12, such as a jacket or rain gear, being collapsed into its sleeve to form a fanny pack, shoulder pack, hand pack or back pack configuration. In accordance with a preferred embodiment of the present invention, left sleeve of apparel 12, such as a jacket or rain gear, is turned inside out and inserted inside the right sleeve. Apparel 12, such as a jacket or rain gear, and apparel 12, such as a jacket or rain gear, and apparel 12, such as a jacket or rain gear, is turned over so that the back and bottom portions are facing upwardly. Apparel 12, such as a jacket or rain gear, is then folded in half and first outwardly extending end 14 and second outwardly extending end 16 of the adjustable belt member are made to lay flat, as seen in FIG. 2. First end 18 of releasable fastener 22 is then pulled through the sleeves of apparel 12, such as a jacket or rain gear, and out at the wrist.

Figure 3:
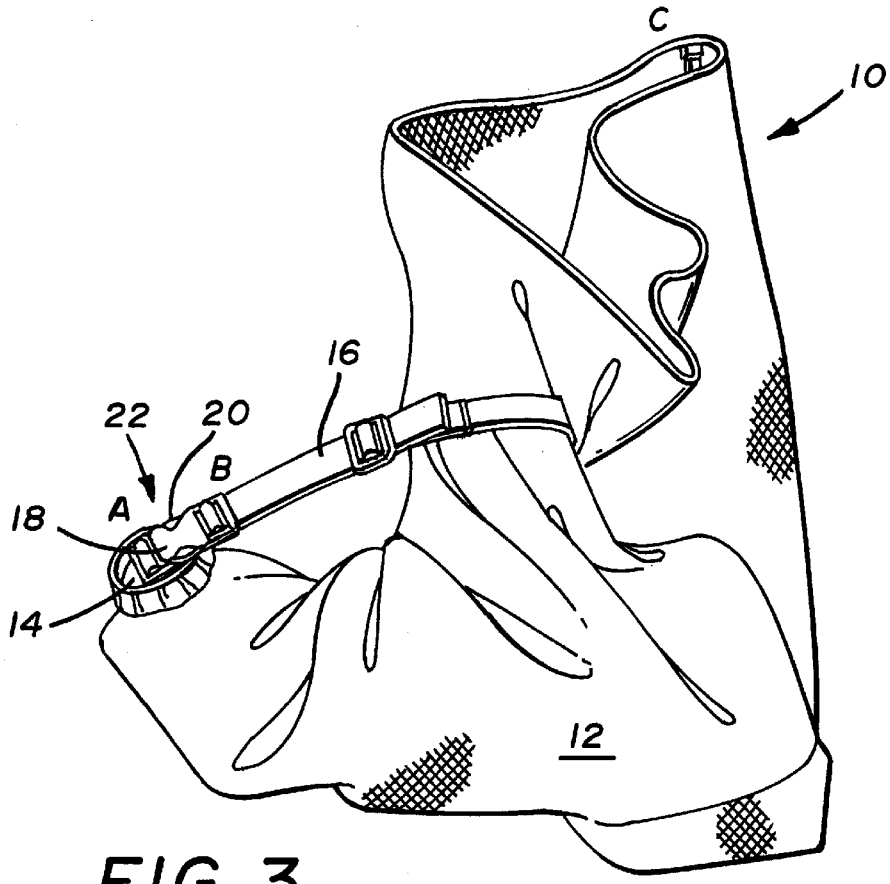
FIG. 3 is a top elevational view of apparel, such as a jacket or rain gear, which is collapsible into its sleeve to form a fanny pack, shoulder pack, hand pack or back pack configuration showing the second step of being collapsed in accordance with the embodiment of the present invention shown in FIG. 1.

Referring now to FIG. 3, which shows a top elevational view of apparel, such as a jacket or rain gear, which is collapsible into its sleeve to form a fanny pack, shoulder pack, hand pack or back pack configuration 10 showing the second step of the method to collapse apparel 12 into its sleeve to form a fanny pack, shoulder pack, hand pack or back pack configuration. In accordance with a preferred embodiment of the present invention, first end 18 of releasable fastener 22 is then connected to second end 20 of releasable fastener 22. The bottom of apparel 12, such as a jacket or rain gear, is then grasped and stuffed through the sleeves until it shows through at the wrist.

Figure 4:
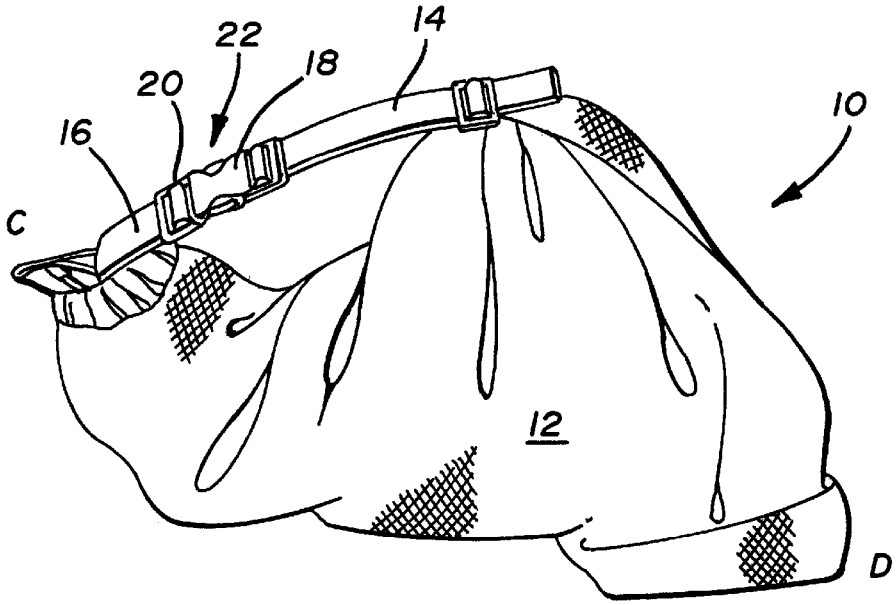
FIG. 4 is a top elevational view of apparel, such as a jacket or rain gear, which is collapsible into its sleeve to form a fanny pack, shoulder pack, hand pack or back pack configuration showing the third step of being collapsed in accordance with the embodiment of the present invention shown in FIG. 1.

Referring now to FIG. 4, which shows a top elevational view of apparel, such as a jacket or rain gear, which is collapsible into its sleeve to form a fanny pack, shoulder pack, hand pack or back pack configuration 10 showing the third step of the method to collapse apparel 12, such as a jacket or rain gear, into its sleeve to form a fanny pack, shoulder pack, hand pack or back pack configuration. In accordance with this embodiment of the present invention, while holding the end of the sleeves of apparel 12, such as a jacket or rain gear, in place with one hand, the neck of apparel 12 is grasped with the other hand and stuffed through the sleeve opening and out of the sleeves.

Figure 5:
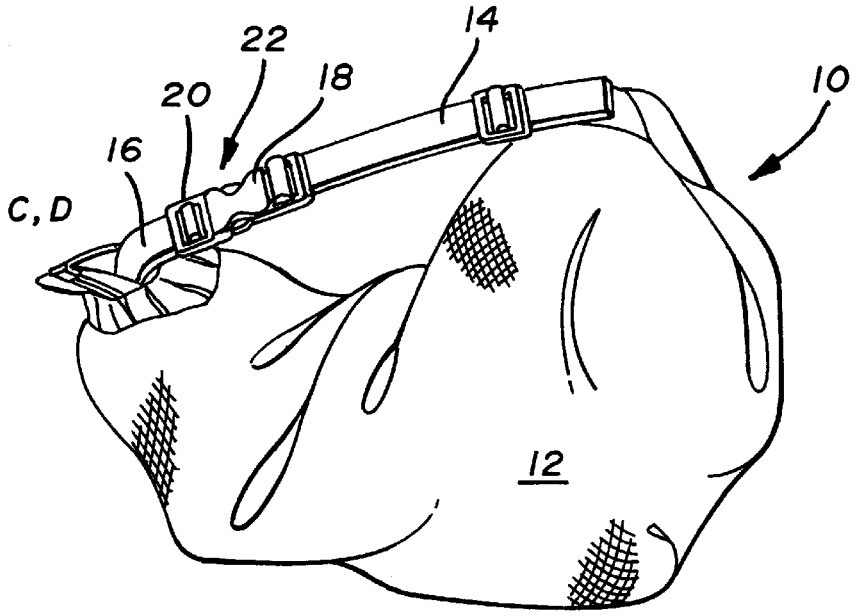
FIG. 5 is a top elevational view of apparel, such as a jacket or rain gear, which is collapsible into its sleeve to form a fanny pack, shoulder pack, hand pack or back pack configuration showing the fourth step of being collapsed in accordance with the embodiment of the present invention shown in FIG. 1.

Referring now to FIG. 5, which shows a top elevational view of apparel, such as a jacket or rain gear, which is collapsible into its sleeve to form a fanny pack, shoulder pack, hand pack or back pack configuration 10 showing the fourth step of the method. In accordance with this embodiment of the present invention, sleeves of apparel 12, such as a jacket or rain gear, are held in place with one hand and the body of apparel 12, such as a jacket or rain gear, is stuffed into the sleeves to form one side of the fanny pack, shoulder pack, hand pack or back pack configuration with the opposite hand.

Figure 6:
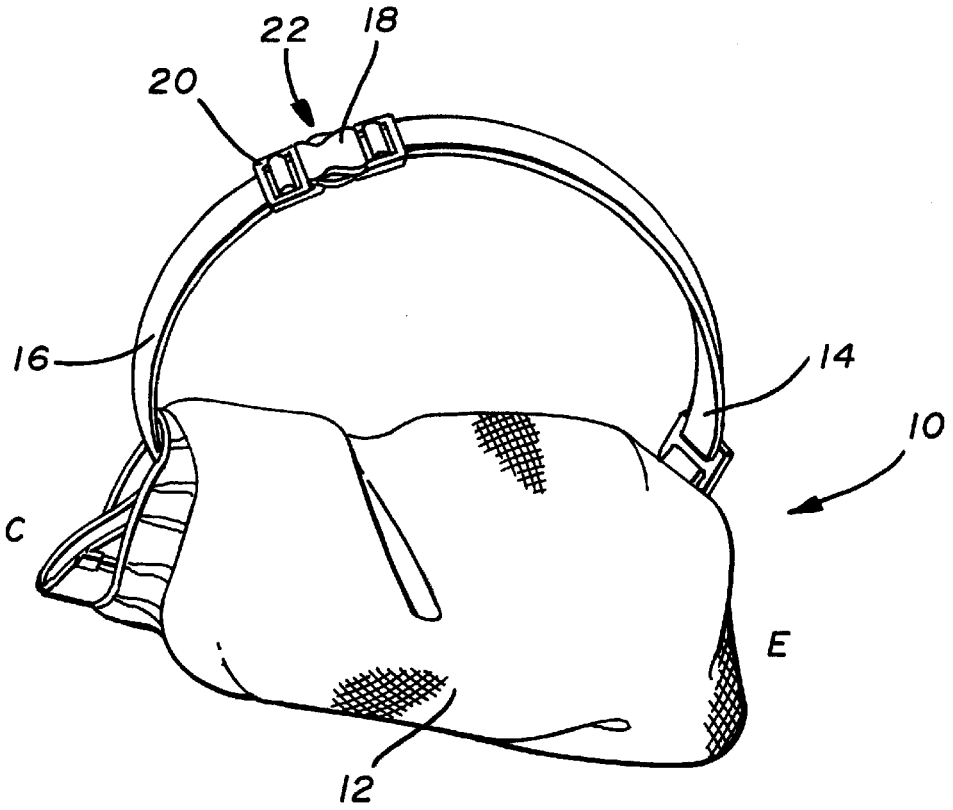
FIG. 6 is a top elevational view of apparel, such as a jacket or rain gear, which is collapsible into its sleeve to form a fanny pack, shoulder pack, hand pack or back pack configuration showing the fifth step of being collapsed in accordance with the embodiment of the present invention shown in FIG. 1.

Referring now to FIG. 6, which shows a top elevational view of apparel, such as a jacket or rain gear, which is collapsible into its sleeve to form a fanny pack, shoulder pack, hand pack or back pack configuration 10 showing the fifth and final step of the method. In accordance with this embodiment of the present invention, a hand is inserted through the sleeves of apparel 12, such as a jacket or rain gear, and the bottom of apparel 12, such as a jacket or rain gear, is pulled inside along with the wrists of the sleeves of apparel 12, to form the fanny pack, shoulder pack, hand pack or back pack configuration.

In the collapsed form, the apparel can be transported as a fanny pack, shouler pack hand pack or back pack. This facilitates use of apparel 10 by allowing the user to easily carry the apparel 10 prior to use being required, without being unsightly or cumbersome. The ability to then carry the collapsed apparel 10 as a fanny pack, shoulder pack, hand pack or back pack gives the user flexibility.

Apparel 12, such as a jacket or rain gear, is preferably fabricated from a non-stretchable, wrinkle resistant, lightweight, comfortable fabric material, such as nylon, which is durable and easy to clean. Referring to the Figures, the first outwardly extending end 14 and second outwardly extending end 16 of the adjustable belt member are attached to an exterior surface on the back of apparel 12, such as a jacket or rain gear. The first outwardly extending end 14 and second outwardly extending end 16 of the adjustable belt member preferably permit a user to readily adjust the length of the adjustable belt member as desired for the various transport configurations. The first end 18 and second end 20, respectively, of releasable fastener 22 are attached to the outwardly extending ends of first outwardly extending end 14 and second outwardly extending end 16 of the adjustable belt member in accordance with a preferred embodiment of the present invention.

In the preferred embodiment of apparel, such as a jacket or rain gear, which is collapsible into its sleeve to form a fanny pack, shoulder pack, hand pack or back pack configuration 10, the adjustable belt member is attached to an exterior surface on the back of apparel 12, such as a jacket or rain gear. This attachment is most preferably accomplished by stitching a six (6) to ten (10) inch center section of the adjustable belt member to an exterior surface on the back of apparel, such as a jacket or rain gear to form the spine of apparel, such as a jacket or rain gear, which is collapsible into its sleeve to form a fanny pack, shoulder pack, hand pack or back pack configuration 10 when collapsed into its sleeve to form a fanny pack, shoulder pack, hand pack or back pack configuration. Alternatively, the adjustable belt member could be removably attached to apparel 12, such as a jacket or rain gear, by, for example, snaps, Velcro® and/or buttons, or not attached at all, although apparel, such as a jacket or rain gear, which is collapsible into its sleeve to form a fanny pack, shoulder pack, hand pack or back pack configuration 10 would slide along the adjustable belt member if the adjustable belt member is not attached to apparel 12, such as a jacket or rain gear. In addition, one or more belt loops, and most preferably two (2) belt loops are attached to an exterior surface at the sides, or more preferably to an exterior surface a predetermined distance in front of the sides to retain and position first outwardly extending end 14 and second outwardly extending end 16 of the adjustable belt member. The belt loops are most preferably attached to apparel 12, such as a jacket or rain gear, by stitching, although belt loops could also be removably attached to apparel 12, such as a jacket or rain gear by, for example snaps, Velcro® and/or buttons, if desired.

If desired, a small pocket could be included in one or both sleeves of apparel 12 such as a jacket or rain gear, to provide a convenient place to carry keys, change and other small items when apparel 12, such as a jacket or rain gear is collapsed into its sleeve to form a fanny pack, shoulder pack, hand pack or back pack configuration. Also, if desired, the product name, along with images, words and/or advertising could be included on one or both sleeves of apparel 12, such as a jacket or rain gear, which would be visible when apparel 12, such as a jacket or rain gear, is collapsed into its sleeve to form a fanny pack, shoulder pack, hand pack or back pack configuration. One advantage of including a small pocket and/or the product name, along with images, words and/or advertising on only one sleeve of apparel 12, such as a jacket or rain gear, is that the user would have a choice as to whether the small pocket and/or the product name, along with images, words and/or advertising would appear depending on which sleeve of apparel 12, such as a jacket or rain gear, is chosen to form a fanny pack, shoulder pack, hand pack or back pack configuration. On the other hand, by including a small pocket and/or the product name, along with images, words and/or advertising on both sleeves of apparel 12, such as a jacket or rain gear, the small pocket and/or the product name, along with images, words and/or advertising would be visible irregardless of which sleeve of apparel 12, such as a jacket or rain gear, is used when apparel 12, such as a jacket or rain gear, is collapsed into its fanny pack, shoulder pack, hand pack or back pack configuration. In addition, if desired, the two (2) sleeves of apparel 12, such as a jacket or rain gear, could have a different appearance, such as different colors and/or patterns, to provide the user with a choice as to the appearance of apparel, such as a jacket or rain gear, which is collapsible into its sleeve to form a fanny pack, shoulder pack, hand pack or back pack configuration 10 when collapsed into its sleeve to form a fanny pack, shoulder pack, hand pack or back pack configuration.

Although the present invention has been described above in detail, the same is by way of illustration and example only and is not to be taken as a limitation on the present invention. For example, other types of material, for example cotton, Gortex® or other synthetic fabric materials could be used to fabricate apparel 12, such as a jacket or rain gear, using the teachings of the present invention. In addition, other materials and arrangements could be utilized for the adjustable belt member and first end 18 and second end 20 of releasable fastener 22, for example, a releasable fastener utilizing snaps, buttons and/or one fabricated from a Velcro® type material. Accordingly, the scope and content of the present invention are to be defined only by the terms of the appended claims.

What is claimed is:

1. A method of collapsing apparel having a first sleeve member, a second sleeve member and an adjustable belt member into a fanny pack, shoulder pack, hand pack and back pack configuration, comprising the steps of:

inserting a first end of said adjustable belt member through one of the first sleeve member and the second sleeve member;

attaching a second end of said adjustable belt member to said first end of said adjustable belt member; and stuffing the remainder of the apparel into said one of the first sleeve member and the second sleeve member to form the fanny pack, shoulder pack, hand pack and back pack configuration.

2. The method in accordance with claim 1, wherein said apparel is fabricated from a fabric material.

3. The method in accordance with claim 1, wherein said apparel is fabricated from a water resistant and wrinkle resistant fabric material.

4. The method in accordance with claim 1, wherein said adjustable belt member is non-removably attached to an exterior surface on the rear of said apparel.

5. The method in accordance with claim 4, wherein said adjustable belt member is attached to an exterior surface on the rear of said apparel by stitching a central portion of said adjustable belt member approximately six (6) to ten (10) inches in length to said exterior surface on the rear of said apparel to form a spine of said fanny pack, shoulder pack, hand pack or back pack configuration.

6. The method in accordance with claim 4, wherein said adjustable belt member is attached to an exterior surface on the rear of said apparel by stitching.

7. The method in accordance with claim 1, wherein said adjustable belt member is removably attached to an exterior surface on the rear of said apparel.

8. The method in accordance with claim 1, further including one or more belt loops attached to an exterior surface of said apparel, said one or more belt loops slidably retain said adjustable belt member therein.

9. The method in accordance with claim 1, further including a first belt loop and a second belt loop attached to an exterior surface of said apparel by stitching, said first belt loop and said second belt loop slidably retaining said adjustable belt member therein.

10. The method in accordance with claim 1, further including a first belt loop and a second belt loop removably attached to an exterior surface of said apparel, said first belt loop and said second belt loop slidably retaining said adjustable belt member therein.

11. The method in accordance with claim 1, wherein one of said first sleeve member and said second sleeve member include a pocket on an exterior surface thereof.

12. The method in accordance with claim 1, wherein said first sleeve member and said second sleeve member each include a pocket on an exterior surface thereof.

13. The method in accordance with claim 1, wherein one of said first sleeve member and said second sleeve member include an image on an exterior surface thereof.

14. The method in accordance with claim 13, wherein said first sleeve member and said second sleeve member each include an image on an exterior surface thereof.

15. The method in accordance with claim 1, wherein said first sleeve member has a different color than said second sleeve member.

16. The method in accordance with claim 1, wherein said adjustable belt member has first and second releasable fasteners at distal ends thereof.

17. The method in accordance with claim 16, wherein said first releasable fastener includes a projecting portion and said second releasable fastener includes a receiving portion and said projecting portion of said first releasable fastener is removably received in said receiving portion of said second releasable fastener.

18. The method in accordance with claim 17, wherein said first releasable fastener and said second releasable fastener are fabricated from a plastic material.

19. A method of collapsing apparel having a first sleeve member, a second sleeve member and an adjustable belt member into a fanny pack, shoulder pack, hand pack and back pack configuration, comprising the steps of:

turning one of the first sleeve member and the second sleeve member inside out and pulling said one of the first sleeve member and the second sleeve member through the other of the first sleeve member and the second sleeve member until approximately eight (8) inches extends from the bottom of said one of the first sleeve member and the second sleeve member;

pulling one end of the adjustable belt member through the first sleeve member and the second sleeve member and out the bottom of said one of the first sleeve member and the second sleeve member;

attaching said one end of said adjustable belt member to said the other end of the adjustable belt member to form a continuous loop;

stuffing the remainder of the apparel into the first sleeve member and the second sleeve member; and pulling said one of the first sleeve member and the second sleeve member across said other of the first sleeve member and the second sleeve member and stuffing said other of the first sleeve member and the second sleeve member into said one of the first sleeve member and the second sleeve member to form the fanny pack, shoulder pack, hand pack and back pack configuration.

* * * * *